United States Patent [19]

Masuda et al.

[11] Patent Number: 4,474,605

[45] Date of Patent: Oct. 2, 1984

[54] PROCESS FOR REFINING HIGH-CHROMIUM STEELS

[75] Inventors: Seiichi Masuda; Yoichi Umeda; Tohru Matsuo, all of Nishinomiya; Masayuki Taga, Kobe; Hidemasa Nakajima, Ibaraki, all of Japan

[73] Assignee: Sumitomo Metal Industries, Ltd., Osaka, Japan

[21] Appl. No.: 345,389

[22] Filed: Feb. 3, 1982

[30] Foreign Application Priority Data

Mar. 3, 1981 [JP] Japan ..... 56-30775

[51] Int. Cl.[3] ..... C21C 7/00

[52] U.S. Cl. ..... 75/60; 75/59; 75/130.5

[58] Field of Search ..... 75/39, 60, 130.5

[56] References Cited

U.S. PATENT DOCUMENTS 3,046,107 7/1962 Nelson ..... 75/59
3,850,617 11/1974 Umowski ..... 75/60
3,854,932 12/1974 Bishop ..... 75/60
3,953,199 4/1976 Michaelis ..... 75/59

*Primary Examiner*—Peter D. Rosenberg
*Attorney, Agent, or Firm*—Burns, Doane, Swecker and Mathis

[57] ABSTRACT

A process for refining high-Cr steel, e.g. 13% Cr steel and 18% Cr steel, is disclosed. The process comprises preparing molten iron in a top-and-bottom blowing converter, heating the molten iron to a predetermined temperature, effecting the decarburization of the thus prepared molten iron by blowing oxygen gas through a top lance against the surface of the molten iron to provide a molten steel while, as bottom-blown gas, initially introducing an oxygen-containing gas into the molten steel then changing to an inert gas when the carbon content of said molten steel is reduced to a predetermined level so as to suppress the oxidation of chromium, and tapping the resulting molten steel out of the converter after adjusting the steel composition.

9 Claims, 5 Drawing Figures

PROCESS FOR REFINING HIGH-CHROMIUM STEELS

This invention relates to a process for refining high-Cr steels, more particularly to a top-and-bottom blowing process for refining high-Cr steels in a highly economical and practical manner by switching the type of gas to be injected into the molten steel through bottom tuyeres in the course of refining.

The refining of high-Cr steels through the top-and-bottom blowing process is usually carried out by using a top-and-bottom blowing converter, in which oxygen gas is top-blown through a top lance and an agitating gas is injected into the molten metal through at least one tuyere provided at the bottom. While the molten metal is being agitated by the agitating gas injected into the molten metal through the tuyere, oxygen is blown into the molten metal through the top lance to effect the decarburization of the molten steel. In the process of refining, a Cr-containing agent is added to the molten metal to adjust the alloy composition to a predetermined high-Cr steel composition.

As in refining plain carbon steels, a series of metallurgical steps are applied to prepare a high-Cr steel through the top-and-bottom blowing process, including the step of decarburization and phosphorization in which decarburization, dephosphorization and heating-up of the charge are mainly intended, or the step of heating-up in which the decarburization and heating-up of the charge are intended, this step being applied to a molten iron which has been subjected to desiliconization and dephosphorization prior to charging to the converter; the step of decarburization in which a Cr-containing agent, e.g. high carbon Fe-Cr alloy is added to the molten steel and the carbon content is lowered to a level of about 0.3%; the step of oxidization in which decarburization further proceeds to reduce the carbon content to a desired level of 0.05% or less and part of the added chromium is oxidized and moved into slag; and the step of reduction in which, after stopping the oxygen blowing through the top lance, a Si-containing agent, e.g. Fe-Si alloy, etc., is added to the molten steel to effect the reduction of chromium with the Si and the recovery of the thus reduced chromium to the molten metal, the chromium having been oxidized and moved into slag during the preceding oxidization step. These metallurgical steps are carried out while agitating the molten metal by injecting an agitating gas into the molten metal through the tuyere.

According to the conventional process, however, a molten steel is at first prepared by using an electric furnace or converter and then the resulting molten steel, which has been partially decarburized in case the converter is used, is charged to an argon-oxygen decarburizing (AOD) furnace in which the molten steel is subjected to decarburization and refining by blowing a mixture of oxygen and argon gases through the tuyere provided at a lower portion of the side wall and the Cr content is adjusted to a predetermined one.

Thus, according to the before mentioned top-and-bottom blowing process, there is no need to use two separate furnaces, but only one top-and-bottom blowing converter is required, resulting in many remarkable advantages regarding construction cost, refining operation, thermal efficiency, yield, etc.

Therefore, two of the inventors of this invention have proposed a new process for refining high-Cr steels by means of the top-and-bottom blowing process (See Japanese Patent Laid-Open Specification No. 115914/1970). It is to be noted, however, that this prior patent application is directed to the refining of a molten steel having a low range of carbon content. It does not teach nor disclose anything about refining a molten steel while it has a carbon content in a rather high range.

In addition, even in the case of the top-and-bottom blowing process, it has been thought that in order to suppress the oxidation of chromium and to promote decarburization the gas to be introduced into the molten steel through the bottom tuyeres should be one inert to the molten steel, e.g. argon gas, and this may dilute the carbon monoxide formed by the reaction between carbon in steel and oxygen introduced. Namely, both in the conventional AOD process and in the top-and-bottom blowing process, argon gas has been used as the bottom-blowing gas to be injected into the molten steel during the entire period of bottom-blowing.

OBJECT OF THE INVENTION

Figure 1:
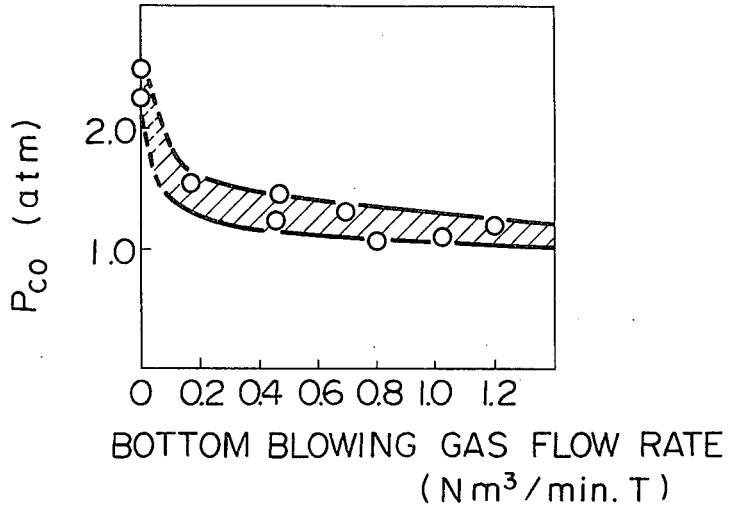
FIG. 1 is a graph showing the relationship between the partial pressure of carbon monoxide gas and the flow rate of the bottom blowing gas.

The object of this invention is to provide a process for refining high-Cr steels in a highly economical and practical manner.

As is shown in the art, in the top-and-bottom blowing process for refining high-Cr steels the decarburization rate of a molten steel is controlled by the carbon concentration while the molten steel is in a low carbon range, i.e. when the concentration of carbon in the molten steel is low, and, therefore, when the carbon content is low, a high degree of Cr oxidation is inevitable due to the presence of oxygen blown onto the molten steel. To the contrary, while the concentration of carbon is high, the decarburization rate is controlled by the amount of oxygen introduced into the molten steel, so that approximately all of the oxygen supplied to the molten steel is consumed for decarburization reactions.

On the basis of the prior art knowledge mentioned above, the inventors of this invention conducted a series of experiments and studied the results thereof to reach this invention.

Namely, according to the findings of the inventors of this invention, there is no need to inject argon gas into the molten steel during the period in which the concentration of carbon in the molten steel is within a high range. An oxygen-containing gas should be injected into the molten steel in order to promote the decarburization thereof. This is contrary to the prior art in which the thinking is that, even when the concentration of carbon in the molten steel is in a high range, it is necessary to inject argon gas so as to reduce the partial pressure of CO gas and to promote decarburization with oxygen.

Furthermore, according to the findings of the inventors of this invention, it is possible to completely prevent the oxidation of chromium by changing the bottom blowing gas from oxygen to argon at the point specified hereinafter even if oxygen gas is injected into the molten steel through the bottom tuyeres. The inventors of this invention also found that the above mentioned boundary point in terms of carbon content may be set at 0.31–0.37% C for 18% Cr steels and 0.22–0.27% C for 13% Cr steels. In this respect, in the prior art it has been thought that the boundary between low carbon range and high carbon range is to be about 0.5% C, which is relatively higher than the boundary point of this invention. This is because by injecting oxygen gas into the molten steel at a high carbon level it is possible to reduce the carbon concentration to a point as close as possible to the theoretical boundary point, while substantially preventing the oxidation of chromium due to a thorough agitation of the molten steel.

According to this invention, therefore, the bottom blowing gas is changed from an oxygen-containing gas to an inert gas such as Ar gas at a point previously determined by considering the proceedings of refining process, particularly the degree of decarburization.

In summary, this invention resides in a process for refining high-Cr steels, which comprises charging a molten metal to a top-and-bottom blowing converter, decarburizing the charged molten metal by blowing pure oxygen through a top lance, while injecting an oxygen-containing gas into the molten metal through at least one tuyere provided with said converter, changing the bottom-blowing gas to an insert gas at the previously determined point, which will be specified in more detail hereinafter and, in a preferred embodiment, simultaneously gradualy reducing the amount of oxygen blown through the top lance.

More specifically, this invention resides in a process for refining high-Cr steel, which comprises preparing molten iron in a top-and-bottom blowing converter, heating the molten iron to a predetermined temperature, effecting the decarburization of the thus prepared molten iron by blowing oxygen gas through a top lance against the surface of the molten iron to provide a molten steel while, as bottom-blown gas, initially introducing an oxygen-containing gas into the molten steel then changing to an inert gas when the carbon content of said molten steel is reduced to a predetermined level higher than the level at which chromium begins to be oxidized so as to suppress the oxidation of chromium, and tapping the resulting molten steel out of the converter after adjusting the steel composition.

When oxygen is injected through a tuyere to the molten steel as an agitating agent, it reacts with the carbon in steel to form two volumes of CO in accordance with the following equation:

$$2[C]+O_2(g)=2CO \quad (1)$$

wherein,
[C]: carbon in steel
$O_2$ (g): oxygen gas
CO (g): carbon monoxide gas

Since the volume of the thus formed CO is twice the volume of the injected oxygen, the CO can agitate the molten steel while it rises upwardly in the molten steel more vigorously than argon gas, which is inert to the molten steel. This vigorous bubbling also promotes the decarburization with oxygen. Thus, by injecting oxygen gas into the molten steel, it is possible to control the carbon level more precisely and rapidly than in the case of argon gas. This means that according to this invention the point at which the bottom blowing gas is changed to an inert gas can be set at a carbon level as close as possible to the point at which the oxidation of chroimum occurs.

Now the limit of carbon concentration, above which the oxidation of Cr does not occur even if oxygen gas is injected into the molten steel, will be considered.

In general, the decarburization and chromium oxidation proceed in accordance with the following equations:

$$[C]+[O]=CO(g) \quad (2)$$

$$[Cr]+[O]=(CrO) \quad (3)$$

wherein,
[O]: oxygen in steel
[Cr]: chromijm in steel
(CrO): CrO in slag

Namely, the CO formed by the reaction of oxygen with carbon in steel rises upwardly to the surface of the melt and is discharged into the atmosphere. The CrO formed by the reaction of oxygen with Cr in steel is absorbed into slag. Procided that the equations (2) and (3) are in an equilibrium state the following equation can be derived from equations (2) and (3) since oxygen is common to both reactions:

$$[C]+(CrO)=[Cr]+CO(g) \quad (4)$$

The equilibrium constants of equation (4) can be shown by the following equation:

$$K = \frac{a_{[Cr]} \cdot P_{CO}}{a_{[C]} \cdot a_{(CrO)}} \quad (5)$$

wherein,
$a_{[Cr]}$: activity of Cr in molten steel
$a_{[C]}$: activity of C in molten steel
$a_{(CrO)}$: activity of CrO in slag
$P_{CO}$: partial pressure of CO gas in the atmosphere In equation (5), $a_{(CrO)}$ may be treated as nearly equal to 1, and the equation (5) may be experimentally shown as in the following:

$$\log \frac{[\%\ Cr] \cdot P_{CO}}{[\%\ C]} = -\frac{13800}{T + 4.2[\%\ Ni]} + 8.76 \quad (6)$$

wherein,
T: molten steel temperature (°K.)
$P_{CO}$: partial pressure of CO gas (atm)
[%Ni]: Ni concentration in molten steel (%)
[%C]: C concentration in molten steel (%)
[%Cr]: Cr concentration in molten steel (%)

While blowing a predetermined amount of oxygen through a top lance, a high-Cr steel was subjected to refining by injecting different amounts of oxygen into the molten steel through the bottom tuyere to determine the point when the oxidation of chromium starts to occur. The resulting data regarding carbon, chromium, and nickel contents and molten metal temperature at said point were substituted for the corresponding items in equation (6), and the $P_{CO}$ at the point when the oxidation of Cr is initiated was calculated. The thus obtained data regarding $P_{CO}$ are plotted with respect to the flow rate of the bottom blowing gas in FIG. 1. The flow rate of oxygen through the top lance was 1.5–3.0 $Nm^3$/min per ton of molten steel. As is apparent from the graphs shown therein, as long as the bottom blowing gas flow rate is 0.1 $Nm^3$/min or higher per ton of molten steel, the equilibrium $P_{CO}$ is in the range of 1.0–1.5 atm. The refining process is carried out under the atmospheric pressure.

Thus, in determining the initial point of Cr oxidation of 18% Cr steel at 1700° C., but the values of $P_{CO}$=1.0–1.5, [%CR]=18, T=1700+273 and [%Ni] into the equation (6); then, by calculation, the carbon content [%C] at the initial point is found to be within the range 0.31–0.37. This means that, when the carbon content is reduced to within 0.31–0.37% at a temperature of 1700° C., the oxidation of Cr is initiated in 18% Cr steels. By the same procedure the carbon content at the initial point is found to be within 0.22–0.27% in case of 13% Cr steels. As long as the carbon content is outside the ranges specified above, 0.31–0.37% for 18% Cr steels and 0.22–0.27% for 13% Cr steels, the oxidation of chromium does not occur even if oxygen is injected through bottom tuyeres into the molten steel. The critical range of carbon content for high-Cr steels of different types can easily be calculated in accordance with the equation (6) in the same manner as in the above.

The relationship between the flow rate of the bottom blowing gas and $P_{CO}$, which is illustrated by the graph in FIG. 1, may be modified to some extent depending on the size or capacity of the converter employed. Thus, it is advisable to determine such a relationship experimentally prior to operation by using the converter to be employed.

It is herein to be noted that the most important feature of this invention is to change the bottom-blowing gas from an oxygen-containing gas to an inlet gas at a predetermined boundary point. The boundary point in terms of carbon concentration can be set at a level as low as possible in accordance with this invention because of the employment of an oxygen-containing gas as the bottom-blowing gas.

Thus, according to this invention, while the composition of the molten steel is at a level over the initial oxidizing point mentioned hereinbefore, oxygen gas may be employed as the bottom-blowing gas without resulting in any substantial oxidation of chromium. Since oxygen gas is less expensive than argon gas, the practice of the refining process of this invention is highly economical. Furthermore, the oxygen injected into the molten steel is formed into CO the volume of which is twice the volume of the oxygen introduced; this results in more vigorous agitation than argon gas in accordance with the equation (1), the oxygen gas injected into the molten steel is also effective for the decarburization of molten steel. Thus, according to this invention, the refining of Cr steels can be conducted in a highly efficient manner.

When pure oxygen gas is used as the bottom-blowing gas, the combustion heat generated in accordance with the equation (1) in the vicinity of tuyere by the reaction between the oxygen introduced therethrough and molten steel surrounding the tuyere melts the tuyere. Therefore, it is advisable to use as the bottom-blowing gas a mixed gas of oxygen and coolant gas. Hydrocarbon gases, nitrogen gas and carbon dioxide gas have been used as a coolant gas in the refining of conventional plain carbon steels. However, when hydrocarbon gases are used, the molten steel is contaminated with hydrogen. If Cr is present in the steel, as in the case of high-Cr steels, the Cr sometimes prevents the removal of hydrogen from steel. Therefore, when nitrogen gas is used, the nitrogen content of the steel is inevitably increased.

However, the use of carbon dioxide gas does not bring about such disadvantage. Rather, the use of carbon dioxide gas is advantageous, because, the same as oxygen gas, when it is injected into the molten steel, its volume becomes twice the original volume in accordance with the following equation:

$$[C]+CO_2(g)=2CO\ (g) \tag{7}$$

wherein, $CO_2$ (g): carbon dioxide in a gaseous form

Thus, not only the cooling of tuyeres but also more vigorous agitation of the molten metal can be achieved by injecting carbon dioxide gas into the molten metal.

From this reason, it is advisable to employ a mixed gas of oxygen and carbon dioxide as the bottom blown gas while the carbon content of the molten steel is at a level higher than the initial point hereinbefore defined. The proportion of each gas, i.e. the volume ratio of carbon dioxide to oxygen is decided by taking into consideration the temperature of the molten steel, carbon content etc. However, it is to be noted that after the point of initial oxidation of chromium, an inert gas such as argon gas should be injected in place of the oxygen-containing gas so as to prevent the oxidation of chromium. In this respect it is to be noted that according to this invention, the point at which the type of bottom blowing gas is changed to an inert gas can be shown in terms of carbon content of the molten steel and can previously be set at a level as close as possible to the point of initial oxidation of chromium, which can also be shown in terms of carbon content.

The flow rate at which a mixture of the oxygen and carbon dioxide gases is injected into the molten steel, the carbon concentration of which is at a level higher than the initial point, is preferably 0.05 $Nm^3$/min or more, more preferably 0.1 $Nm^3$/min or more per ton of molten steel.

Figure 2:
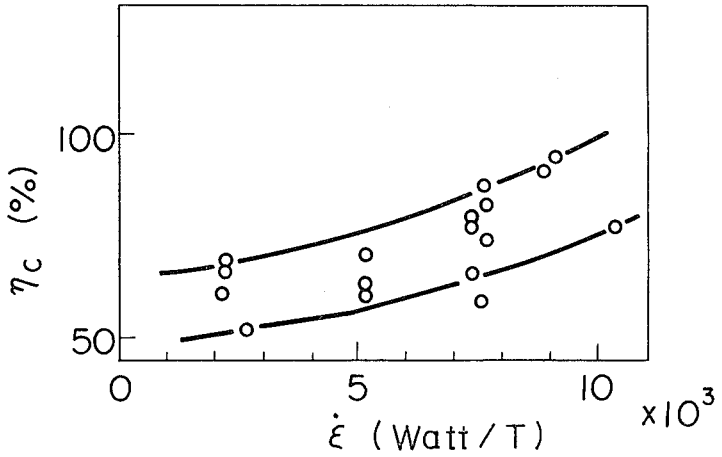
FIG. 2 is a graph showing the relationship between the rate of dissipation of energy density and the oxygen efficiency for decarburization.

In FIG. 2, there is shown a graph indicating a relationship between the rate of dissipation of energy density ($\dot{\epsilon}$) and oxygen efficiency for decarburization ($\eta_c$) of a molten steel in a high carbon range, i.e. after desiliconization but before reaching the initial point. This relationship was obtained by using a real top-and-bottom blowing converter and AOD furnace. The rate of dissipation of energy density is defined by the following equation (8). Usually, this sort of parameter is used as a factor indicating the strength of agitation of the molten steel in a refining furnace.

$$\dot{\epsilon}=28.5QT\cdot\log(1+H/1.48) \tag{8}$$

wherein, $\dot{\epsilon}$: rate of dissipation of energy density per ton of molten steel (watt/T)

Q: bottom blowing gas flow rate per ton of molten steel ($Nm^3$/min. T)

H: depth of molten steel in the converter (m)

In addition, the oxygen efficiency for decarburization ($\eta_c$) may be defined as the ratio of reduction in carbon concentration with respect to the amount of oxygen blown into the molten steel through the top lance.

As is apparent from the data shown in FIG. 2, as long as the rate of dissipation of energy density ($\dot{\epsilon}$) is within the range of 2000–5000 watt/T or higher, the oxygen efficiency for decarburization on the same level as that in the conventional AOD or top-and-bottom blowing process can be obtained.

Thus, when the depth of the molten steel is 1.7 m and the weight of molten steel to be treated is 170 toms, which are usual refining conditions, a preferable gas flow rate can be calculated to be 0.05 $Nm^3$/min or more per ton of molten steel in accordance with the equation (8), because, as shown in the equations (1) and (7), the volume of the gas introduced into the molten steel increases to twice the original volume. Therefore, under the usual conditions, it is advisable to introduce the combined oxygen and carbon dioxide gas at a flow rate of 0.05 $Nm^3$/min or more per ton of molten steel. From a practical viewpoint, the combined oxygen and carbon dioxide gas is injected into the molten steel at a flow rate of 0.1 $Nm^3$/min or more, usually 0.17 $Nm^3$/min or more per ton of molten steel.

Thus, in a preferred embodiment of this invention a combined gas of oxygen and carbon dioxide is injected into the molten steel through the bottom tuyere at a flow rate of 0.05 $Nm^3$/min or more, preferably 0.1 $Nm^3$/min or more per ton of molten steel so as to agitate the molten steel and simultaneously to carry out the decarburization of the molten steel by the oxygen gas blown through the top lance until the carbon content of the molten steel to be refined is reduced to the initial point of chromium oxidation, which can be predetermined by the equation (6) and data in FIG. 1. After the carbon content of the molten steel reaches the initial point, where the oxidation of chromium is initiated, the gas injected through the bottom tuyeres has to be changed from the combined gas of oxygen and carbon dioxide to an inert gas, e.g. argon gas. And after this point, the flow rate of oxygen blown through the top lance may be decreased gradually at a rate taught by the prior art patent application mentioned hereinbefore. According to the disclosure made therein, the decarburization rate during the period of time during which the carbon content of the molten steel has been lowered beyond the initial point can be shown by the following formula:

$$\frac{d[\%\ C]}{dt} = -\alpha\left([\%\ C] + \frac{\frac{[\%\ Cr] \times W \times 10^{-2}}{K \times M_C} \times \frac{d[\%\ C]}{dt}}{N_{Ar} - \frac{d[\%\ C]}{dt} \times \frac{W \times 10^{-2}}{M_C}}\right) \quad (9)$$

wherein, $\alpha$: coefficient of reaction rate

W: weight of molten steel $M_C$: atomic weight of carbon $N_{Ar}$: mol number of inert gas On the basis of the relationship between d[%C]/dt and [%C], a decarburization rate at a predetermined level of [%C] can be obtained. Then, using the thus obtained decarburization rate, the requisite amount of oxygen can be calculated accordingly. Furthermore, depending on the requisite amount of oygen the flow rate of oxygen blown through the top lance can be decreased as the carbon content of the molten steel decreases, so that the oxidation of chromium can be reduced as much as possible.

Figure 3:
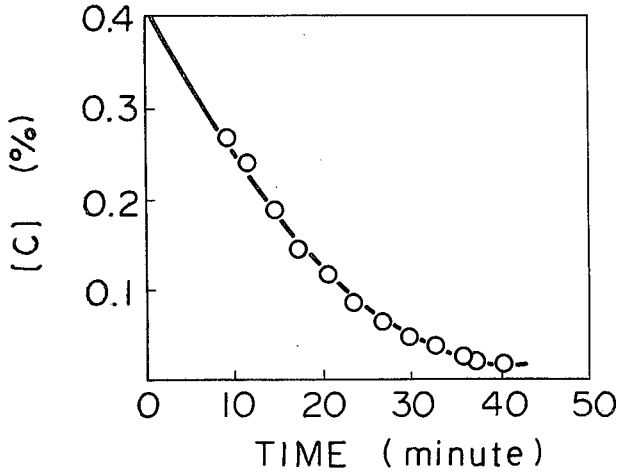
FIG. 3 is a graph showing the change in carbon concentration in molten steel after switching the bottom-blowing gas from an oxygen-containing gas to argon gas.

In order to prove the reliability of the formula (9), a series of experiments were conducted and the results thereof are summarized in FIG. 3, in which the axis of abscissas indicates the time (minute) and the axis of ordinates indicates the carbon concentration in molten steel (C%). The measured values of carbon concentration are shown by the symbol "O". The solid line indicates the theoretical change in carbon concentration calculated in accordance with the formula (9). As is apparent from FIG. 3, the change in carbon concentration calculated from the formula is substantially the same as that shown by the experimental data.

Figure 4:
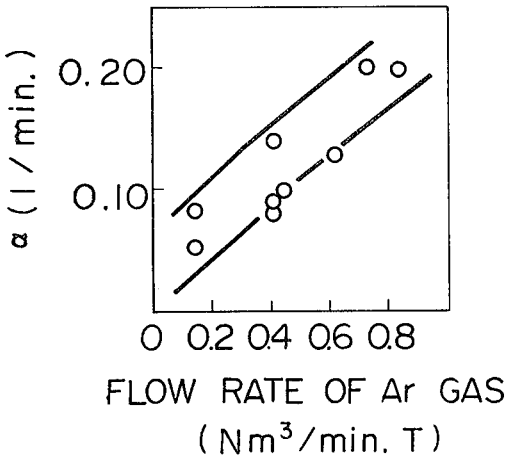
FIG. 4 is a graph showing the relationship between a decarburization coefficient and a flow rate of bottom-blowing gas.

The relationship between a decarburization coefficient and the flow rate of Ar gas is shown in FIG. 4.

Figure 5:
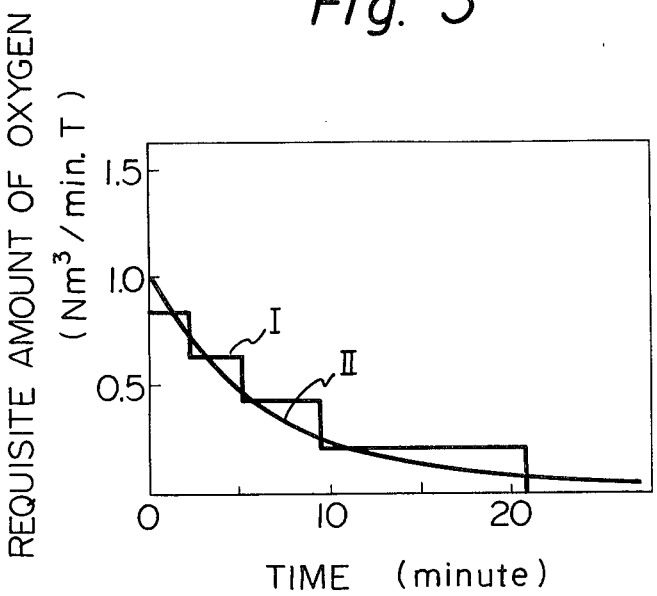
FIG. 5 is a graph showing the change in the amount of oxygen required for decarburization after the bottom blowing gas was changed to argon gas.

FIG. 5 shows the change in the amount of oxygen required for decarburization. Curve I indicates a continuous change in the required amount of oxygen, which is calculated on the basis of the equation (9) above. Curve II is a stepwise modification. After the initial point of this invention, the amount of oxygen blown through the top lance may be decreased in accordance with Curve I or II.

Since carbon monoxide gas is generated during decarburization and is discharged out of the molten steel, it is advisable to effect combustion of the thus generated carbon monoxide gas with oxygen supplied through the top lance or sublance. Utilizing the combustion heat of carbon monoxide the reduction in temperature of the molten steel may be compensated to maintain the temperature thereof at a predetermined level. During the reduction period (the period after finishing the decarburization), the bubbling with argon gas is continued and a silicon-containing material, e.g. Fe-Si alloy etc. is added to the molten steel to reduce the chromium oxide in the slag. The thus reduced chromium is then moved into the molten steel.

This invention will now be described in more detail in conjunction with working examples.

EXAMPLE 16.5% Cr steel was prepared in accordance with this invention using a 150 ton top-and-bottom blowing converter. In this example, the initial point was calculated from the equation (6) hereinbefore mentioned ($P_{CO}$=1-.0–1.5) to be between 0.35–3.38% C. That is, when the carbon content reached 0.38% C, then the bottom blowing gas was changed from an oxygen plus carbon dioxide gas to argon gas.

Experimental conditions including bottom gas flow rate and flow rate of oxygen blown through the top lance are summaryized in Table 1 below. The refining process disclosed therein was divided into two parts called Period I and Period II. According to this invention, during Period I an oxygen+carbon dioxide gas was injected into the molten steel through the bottom tuyere and then, in Period II, instead of the oxygen-containing gas, argon gas was introduced into the molten steel through the bottom tuyere. And simultaneously the amount of oxygen gas blown through the top lance was decreased stepwise as shown in Curve II in FIG. 5.

For comparison, in Comparative Example 1 argon gas was injected into the molten steel through the bottom tuyere throughout the entire period of time of operation and in Comparative Example 2 the bottom blowing gas was changed from the oxygen+carbon dioxide gas to argon gas when the carbon content was at a point slightly lower than the initial point in this invention. That is, in Period II the bottom blowing gas was changed to argon gas when the carbon content had lowered to 0.20%, which is significantly lower than the 0.38% in this invention. In addition, in Comparative Examples 1 and 2, the amount of the top-blowing oxygen gas was changed as shown in Table 1.

The refining process of this invention comprises the steps of heating-up, decarburization in Period I, decarburization in Period II and reduction. As shown in Table 2, many kinds of raw materials were added in each of these steps. At the beginning of operations, molten iron was charged to the converter and oxygen-blowing through the top lance was started. After heating-up was finished, the charge chromium, a high carbon Fe-Mn alloy and part of burnt lime were charged to the converter while effecting the top blowing of oxygen. In the reduction stage following the decarburization stage the rest part of the burnt lime, an Fe-Si alloy and fluorite were also charged to the converter. Chemical analysis and molten metal temperature at each of the above stages are shown in Tables 3, 4 and 5 respectively for the Working Example of this invention, Comparative Example 1 and Comparative Example 2.

TABLE 1

| | Carbon % at the end of Period I | Oxygen top-blowing rate ($Nm^3/hr$) | | Bottom-blowing gas in Period I | | Bottom-blowing gas in Period II | |
|---|---|---|---|---|---|---|---|
| | | Period I | Period II | Type of gas | Flow rate ($Nm^3/hr$) | Type of gas | Flow rate ($Nm^3/hr$) |
| This invention | 0.38 | 24000 | FIG. 5 | $O_2/CO_2$ | 2620/650 | Ar | 6500 |
| Comparative Ex. 1 | 0.46 | 24000 | 4500 | Ar | 3270 | Ar | 3270 |
| Comparative Ex. 2 | 0.20 | 24000 | 3800→1900 | $O_2/CO_2$ | 2620/650 | Ar | 3300 |

TABLE 2

| | This invention | | Comparative Example 1 | | Comparative Example 2 | |
|---|---|---|---|---|---|---|
| | Weight (ton) | Time when added | Weight (ton) | Time when added | Weight (ton) | Time when added |
| Molten iron | 129 | At the beginning | 120 | At the beginning | 121 | At the beginning |
| Charge Cr | 45.5 | After heating-up stage | 45.0 | After heating-up stage | 45.0 | After heating-up stage |
| H.C Fe—Mn alloy | 1.3 | | 1.3 | | 1.25 | |
| Burnt lime | 11.0 | | 16.0 | | 10.0 | |
| | 10.0 | During the reduction stage | — | During the reduction stage | 17.0 | During the reduction stage |
| Fe—Si alloy | 4.8 | | 4.4 | | 5.1 | |
| Fluorite | 3.0 | | 2.0 | | 3.8 | |

TABLE 3

| This invention | C | Si | Mn | P | S | Cr | Temp. (°C.) |
|---|---|---|---|---|---|---|---|
| | | | | | | (% by weight) | |
| Molten iron | 4.47 | Tr. | 0.14 | 0.001 | 0.002 | — | 1230 |
| After finishing the heating-up | 0.40 | Tr. | 0.09 | 0.014 | 0.013 | — | 1650 |
| At the end of Period I | 0.38 | 0.03 | 0.54 | 0.019 | 0.018 | 16.39 | 1725 |
| At the end of Period II | 0.02 | 0.01 | 0.37 | 0.020 | 0.016 | 14.90 | 1700 |
| At the end of reduction stage | 0.05 | 0.54 | 0.57 | 0.021 | 0.001 | 16.47 | 1630 |

Tr.: Trace

TABLE 4

| Comparative Example 1 | C | Si | Mn | P | S | Cr | Temp. (°C.) |
|---|---|---|---|---|---|---|---|
| | | | | | | (% by weight) | |
| Molten iron | 4.35 | Tr. | 0.18 | 0.001 | 0.004 | — | 1205 |
| After finishing the heating-up | 0.37 | Tr. | 0.10 | 0.012 | 0.016 | — | 1640 |
| At the end of Period I | 0.46 | 0.03 | 0.46 | 0.018 | 0.020 | 16.08 | 1710 |
| At the end of Period II | 0.01 | 0.02 | 0.51 | 0.020 | 0.014 | 13.85 | 1720 |
| At the end of reduction stage | 0.03 | 0.30 | 0.67 | 0.022 | 0.002 | 16.79 | 1640 |

Tr.: Trace

TABLE 5

| Comparative Example 2 | C | Si | Mn | P | S | Cr | Temp. (°C.) |
|---|---|---|---|---|---|---|---|
| | | | | | | (% by weight) | |
| Molten iron | 4.44 | Tr. | 0.13 | 0.002 | 0.005 | — | 1220 |
| After finishing the heating-up | 0.39 | Tr. | 0.08 | 0.011 | 0.018 | — | 1635 |
| At the end of Period I | 0.20 | 0.02 | 0.38 | 0.019 | 0.023 | 14.85 | 1785 |
| At the end of Period II | 0.02 | 0.01 | 0.32 | 0.021 | 0.024 | 13.08 | 1770 |
| At the end of reduction stage | 0.05 | 0.32 | 0.55 | 0.023 | 0.005 | 16.53 | 1700 |

Tr.: Trace

As the data in these Tables show, in Comparative Example 1, when the bottom blowing gas in Period I was argon gas, the degree of agitation was low even though the amount of the bottom blowing gas was the same as in the Working Example of this invention. Therefore, the degree of oxidation of chromium in Comparative Example 1 was higher than in this invention. In addition oxygen efficiency for decarburization during Period I following the stage of desiliconization was as low as 90%.

On the other hand, in Comparative Example 2, the injection of the $O_2$-containing gas was continued until the carbon concentration in steel was reduced to as low as 0.20% and since the amount of oxygen blown through the top lance was relatively large, so in this example, the concentration of chromium at the end of Period I was 14.85%, which is thought to be extremely low. This means that in Comparative Example 2 the degree of oxidation of chromium was much higher than in the other two examples. Thus, it was necessary to add a large amount of Fe-Si alloy to reduce the thus oxidized chromium, resulting in a temperature rise to 1700° C., a relatively high temperature, at the end of the reduction stage.

In contrast, according to this invention, since the bottom blowing gas was an oxygen+carbon dioxide gas during Period I, a powerful agitation of the molten steel was established. In addition, the bottom blowing gas was changed from the above mixed gas to argon gas just before 0.38% C, the initial point at which the oxidation of chromium is initiated. Therefore, in the process according to this invention the oxidation of chromium was negligible in comparison with that in the other two examples. The oxygen efficiency for decarburization was at a level of 97%, which is also higher than in the two comparative examples.

Also, it should be noted that the improvements effected by this invention were obtained by using an oxygen-containing gas, e.g. an oxygen+carbon dioxide gas, which is less expensive than argon gas. In addition, since the volume of the bottom blowing gas injected into the molten steel increases to twice its original volume, resulting in vigorous agitation of the molten steel, it is possible to markedly reduce the operating cost in refining high-Cr steels. Thus, according to this invention, it is possible to refine high-Cr steel in a highly economical and practical manner.

What is claimed is:

1. A process for refining high-Cr steel, which comprises preparing molten iron in a top-and-bottom blowing converter, heating the molten iron to a predetermined temperature, effecting the decarburization of the thus prepared molten iron by blowing oxygen gas through a top lance against the surface of the molten iron to provide a molten steel while, as bottom-blown gas, initially introducing an oxygen-containing gas into the molten steel then changing said bottom-blown gas to an inert gas when the carbon content of said molten steel is reduced to a predetermined level higher than the level at which the oxidation of chromium starts to occur so as to suppress the oxidation of chromium, the molten steel being kept under atmospheric pressure in the top-and-bottom converter during production, and tapping the resulting molten steel out of the converter after adjusting the steel composition.

2. A process as defined in claim 1, in which the oxygen-containing gas is a mixture of oxygen and carbon dioxide gases.

3. A process as defined in claim 1, in which the carbon level at which the oxidation of chromium is started is a boundary point at which the reactions of decarburization and chromium oxidation are in an equilibrium state.

4. A process as defined in claim 3, in which the carbon level at which the oxidation of chromium is started is determined by using the following equation, in which the partial pressure of CO gas in an equilibrium state is previously determined by experiments:

$$\log \frac{[\%\ \mathrm{Cr}]P_{CO}}{[\%\ \mathrm{C}]} = -\frac{13800}{T + 4.2[\%\ \mathrm{Ni}]} + 8.76$$

wherein,

T: Molten steel temperature (°K.)

$P_{CO}$: Partial pressure of CO gas (atm)

[%Ni]: Ni concentration in molten steel (%)

[%C]: Carbon concentration in molten steel (%)

[%Cr]: Cr concentration in molten steel (%).

5. A process as defined in claim 1, in which said inert gas is argon gas.

6. A process as defined in claim 1, in which after the bottom blowing gas has been changed to the inert gas, the amount of oxygen blown through the top lance is gradually decreased.

7. A process as defined in claim 6, in which the amount of oxygen blown through the top lance is decreased in a continuous manner.

8. A process as defined in claim 6, in which amount of oxygen blown through the top lance is decreased in stepwise.

9. A process as defined in claim 1, in which the bottom blowing of the inert gas is continued until the resulting molten steel is tapped out of the converter.

* * * * *